US011707132B2

(12) United States Patent
Ciccaci et al.

(10) Patent No.: US 11,707,132 B2
(45) **Date of Patent: *Jul. 25, 2023**

(54) FREELY INSTALLABLE COOKER

(71) Applicant: WHIRLPOOL EMEA S.P.A., Pero (IT)

(72) Inventors: Sandro Ciccaci, Sassoferrato (IT); Egle Armonaviciute, Cagli (IT); Maurizio Tursini, Fabriano (IT); Mirco Palpacelli, Jesi (IT)

(73) Assignee: Whirlpool Corporation, Benton Harbor, MI (US)

( * ) Notice: Subject to any disclaimer, the term of this patent is extended or adjusted under 35 U.S.C. 154(b) by 790 days.

This patent is subject to a terminal disclaimer.

(21) Appl. No.: 16/511,357

(22) Filed: Jul. 15, 2019

(65) Prior Publication Data

US 2019/0335900 A1 Nov. 7, 2019

Related U.S. Application Data

(63) Continuation of application No. 15/037,726, filed as application No. PCT/IB2014/065709 on Oct. 30, 2014, now Pat. No. 10,398,225.

(30) Foreign Application Priority Data

Nov. 21, 2013 (IT) ..... PR2013A000094

(51) Int. Cl.

| | |
|---|---|
| ***A47B 77/08*** | (2006.01) |
| ***F24C 15/30*** | (2006.01) |
| ***F24C 15/08*** | (2006.01) |

(52) U.S. Cl.

CPC ..... *A47B 77/08* (2013.01); *F24C 15/08* (2013.01); *F24C 15/30* (2013.01)

(58) Field of Classification Search

CPC ..... A47B 77/08; F24C 15/08; F24C 15/30
USPC ..... 99/340, 337, 339, 400, 422, 425, 444; 219/452.13, 457.1, 459.1, 463.1, 485; 126/213, 214 B, 37 B

See application file for complete search history.

(56) References Cited

U.S. PATENT DOCUMENTS

| | | | | |
|---|---|---|---|---|
| 1,667,521 A | | 4/1928 | Alber | |
| 1,885,041 A | | 10/1932 | Baker | |
| 1,948,402 A | | 2/1934 | Teller et al. | |
| 2,036,523 A | | 4/1936 | Freemon | |
| 2,414,163 A | * | 1/1947 | Barnsteiner | F24C 15/104 126/39 BA |
| 2,738,411 A | * | 3/1956 | Sandin | F24C 15/30 219/452.13 |
| 2,798,930 A | * | 7/1957 | Frost | F24C 15/102 219/403 |
| 3,064,554 A | | 11/1962 | Lamb | |

(Continued)

FOREIGN PATENT DOCUMENTS

| | | |
|---|---|---|
| DE | 102005032510 | 9/2006 |
| DE | 202012100009 | 4/2012 |

(Continued)

*Primary Examiner* — Nathaniel E Wiehe
*Assistant Examiner* — Ket D Dang
(74) *Attorney, Agent, or Firm* — Price Heneveld LLP

(57) ABSTRACT

Freely installable cooker comprising:
a support structure;
a first cooking module removable, interchangeable and positionable in a first housing of the support structure.

20 Claims, 10 Drawing Sheets

(56) References Cited

U.S. PATENT DOCUMENTS

| | | | | | |
|---|---|---|---|---|---|
| 3,375,775 | A * | 4/1968 | Folmar | A47J 37/0676 99/446 |
| 3,790,750 | A | 2/1974 | Giannini | |
| 4,195,560 | A * | 4/1980 | DuBois | A47J 37/0676 219/448.11 |
| 4,235,282 | A * | 11/1980 | de Filippis | A47J 39/006 219/400 |
| 5,182,438 | A * | 1/1993 | Oakes | A47J 39/006 219/521 |
| 5,403,997 | A * | 4/1995 | Wimpee | G05D 23/1912 219/386 |
| 5,975,660 | A | 11/1999 | Tisbo et al. | |
| 6,027,192 | A | 2/2000 | Irace | |
| 6,034,355 | A * | 3/2000 | Naderi | A47J 39/006 219/386 |
| 6,111,224 | A * | 8/2000 | Witt | H05B 3/00 219/214 |
| 7,134,673 | B2 | 11/2006 | Ferraro et al. | |
| 8,430,254 | B2 | 4/2013 | Kunis | |
| 10,398,225 | B2 * | 9/2019 | Ciccacci | F24C 15/30 |
| 2004/0045952 | A1 | 3/2004 | Rhinehart | |
| 2006/0049725 | A1 | 3/2006 | Simon | |
| 2010/0093257 | A1 | 4/2010 | Elliott | |
| 2011/0041831 | A1 | 2/2011 | Dettloff | |

FOREIGN PATENT DOCUMENTS

| | | | | |
|---|---|---|---|---|
| EP | 1245172 | | 10/2002 | |
| EP | 2018820 | B1 * | 1/2011 | F24C 15/08 |
| GB | 2311128 | | 9/1997 | |
| GB | 2346438 | | 8/2000 | |
| WO | 2004062444 | | 7/2004 | |
| WO | 2012032460 | | 3/2012 | |

* cited by examiner

FREELY INSTALLABLE COOKER

CROSS-REFERENCE TO RELATED APPLICATIONS

The present application is a continuation of U.S. patent application Ser. No. 15/037,726 filed May 19, 2016, now U.S. Pat. No. 10,398,225, entitled FREELY INSTALLABLE COOKER, which is a national stage of PCT/IB2014/065709, filed Oct. 30, 2014, entitled FREELY INSTALLABLE COOKER, which claims priority to Italian Application No. PR2013A000094 filed Nov. 21, 2013, the entire disclosures of which are hereby incorporated herein by reference.

TECHNICAL FIELD

The present invention relates to a freely installable cooker and a method for its realization.

STATE OF THE ART

Freely installable cookers are known wherein various household electrical appliances are assembled in a support structure, each in a specific housing afforded inside said structure. For example, for the realization of a predetermined freely installable cooker, a predetermined cooker hob and a predetermined oven are added to a given structure. A disadvantage of said construction solution is linked to the limited possibility of customizing a specific product. This leads to considerable costs, since numerous assembly lines must be developed to diversify production in order to satisfy the product differences demanded by the market.

AIM OF THE INVENTION

In this context, the technical task underpinning the present invention is to provide a freely installable cooker which allows a high level of customization to be obtained while reducing production costs to a minimum. A further object of the present invention is allowing a user to intervene on a cooker already purchased and adapt it to changed needs.

BRIEF DESCRIPTION OF THE DRAWINGS

The technical task set and the objects specified are substantially attained by a freely installable cooker comprising the technical characteristics as set out in one or more of the accompanying claims.

Further characteristics and advantages of the present invention will become more apparent from the following indicative, and hence non-limiting, description of a preferred, but not exclusive, embodiment of a freely installable cooker as illustrated in the appended drawings, in which.

DETAILED DESCRIPTION OF PREFERRED EMBODIMENTS OF THE INVENTION

Figure 2:
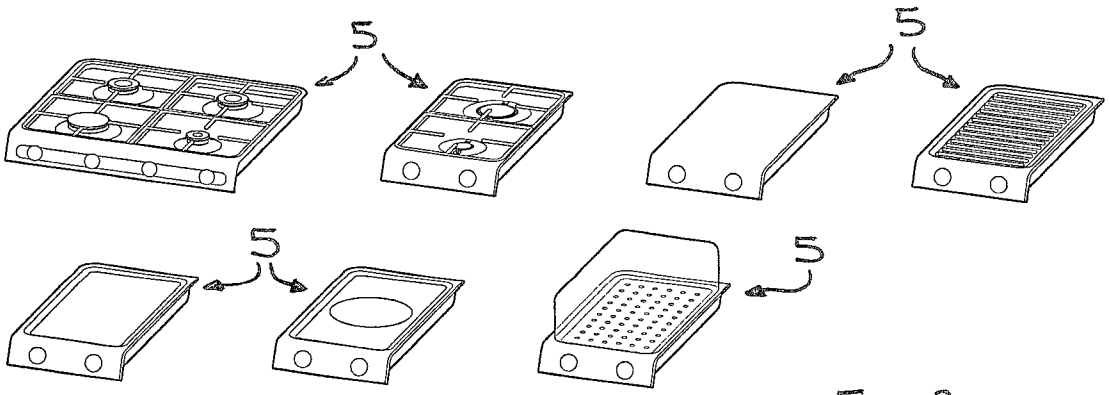
FIGS. 2 and 3 show components to be used on the cooker according to the present invention.

In the accompanying drawings, number 1 indicates a freely installable cooker. "Freely installable cooker" means an independent structure which allows cooking of food products. It is to be considered an alternative to integrated recessed cookers developing continuously on equipped walls. Said freely installable cooker 1 comprises a support structure 2.

The freely installable cooker 1 comprises a first functional module 5. Opportunely, the first functional module 5 is a first cooking module (and therefore used for cooking the food). Said first functional module 5 is removable with respect to the support structure 2. Opportunely, the first cooking module 5 is interchangeable (and replaceable with other functional modules). It is positionable in a first housing 20 of the support structure 2.

Opportunely, the freely installable cooker 1 comprises a resting surface 3 accessible from above.

The freely installable cooker 1 comprises a front wall 31 which extends between the top and the bottom. Typically, the front wall 31 is an opposite wall to a rear wall which is destined to face a wall of the compartment in which the freely installable cooker 1 is positioned.

Figure 6:
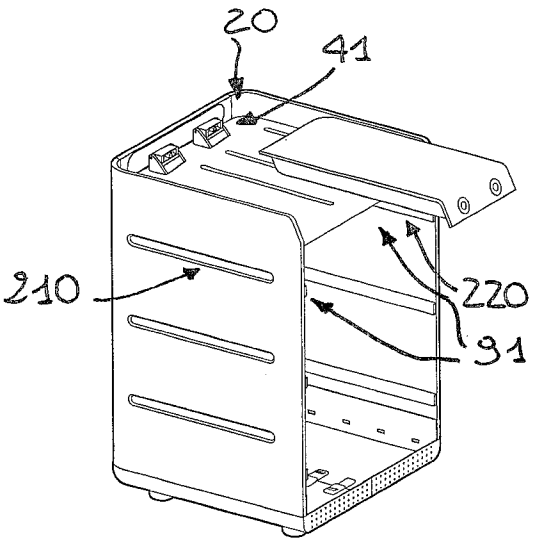
FIGS. 6, 7, 8 show a cooker according to the present invention partially assembled and in different configurations.
Figure 7:
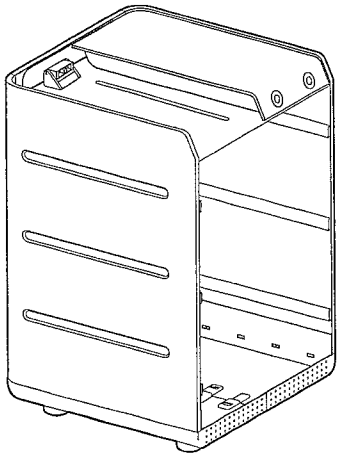
Figure 8:
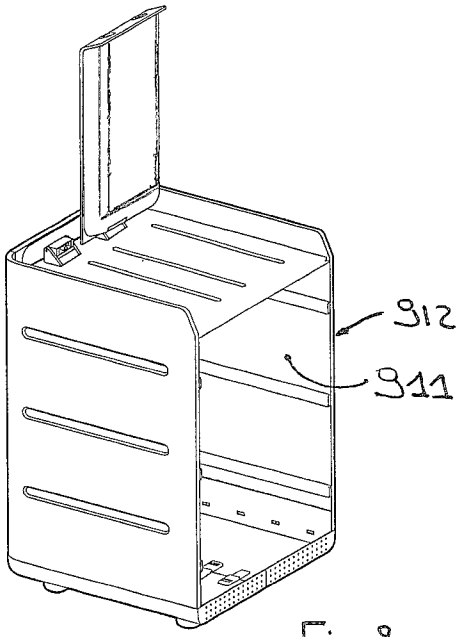
Figure 9:
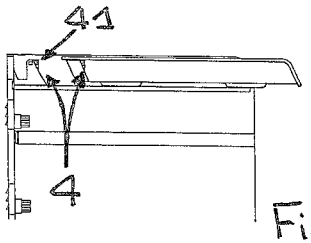
FIGS. 9, 10, 11 show a side view of FIGS. 6, 7, 8.
Figure 10:
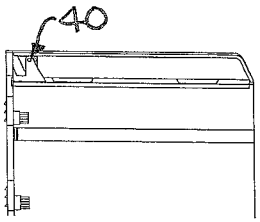
Figure 11:
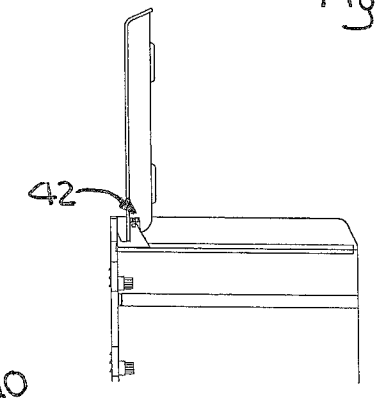

The first housing 20 may be afforded on said resting surface 3. This case occurs especially when the first cooking module 5 is a cooker hob (see for example FIGS. 6, 7, 8). Opportunely, the first cooking module 5 could be an induction, grill, steam cooker hob, Tappan Yaki, or Wok. Opportunely, on the resting surface 3 two or more cooker hobs could be applied alongside each other, each of which could be removable and replaceable.

Figures 12, 13, 14, 15:
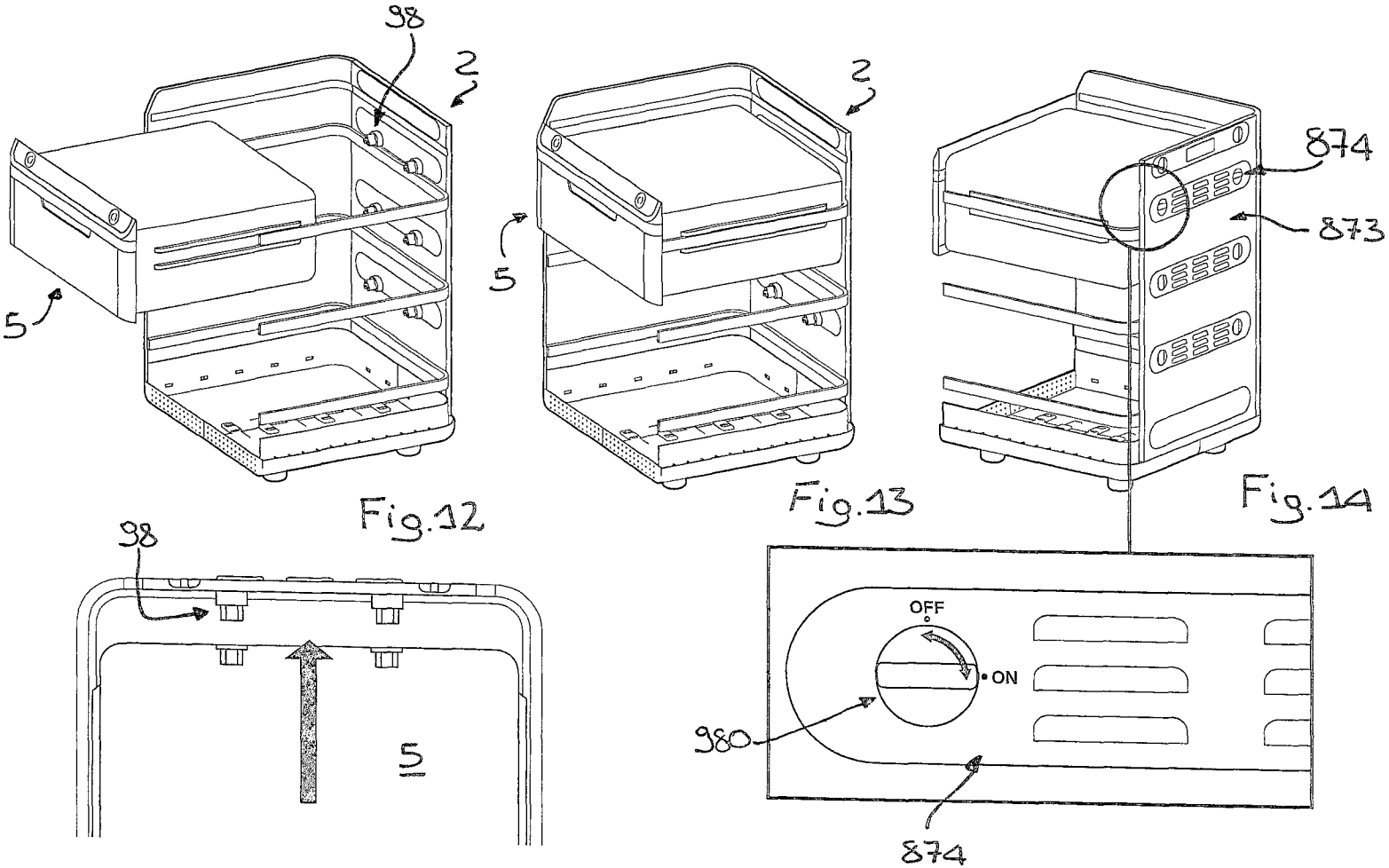
FIGS. 12, 13 show a cooker according to the present invention partially assembled and in different configurations.
FIG. 14 shows a different viewpoint to the one shown in FIG. 13.
FIG. 15 is a view from above of FIG. 12.

In an alternative embodiment, the first housing 20 could be positioned beneath the resting surface 3. In that case, the front wall 31 is defined at least partly by a door of said first functional module 5. Also in that case, the first functional module 5 could be a cooking module and, in particular, is an oven (but could also be a dishwasher or a refrigerator). See, for example, FIG. 12, 13 or 14.

Figure 20:
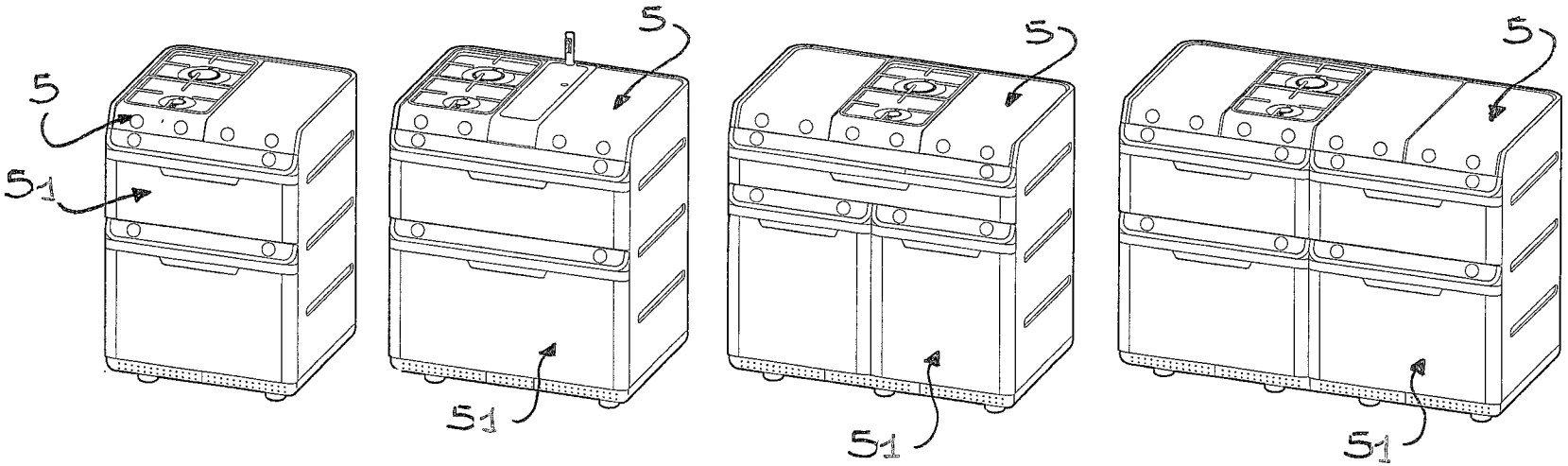
FIG. 20 shows different cookers according to the present invention.
Figure 21:
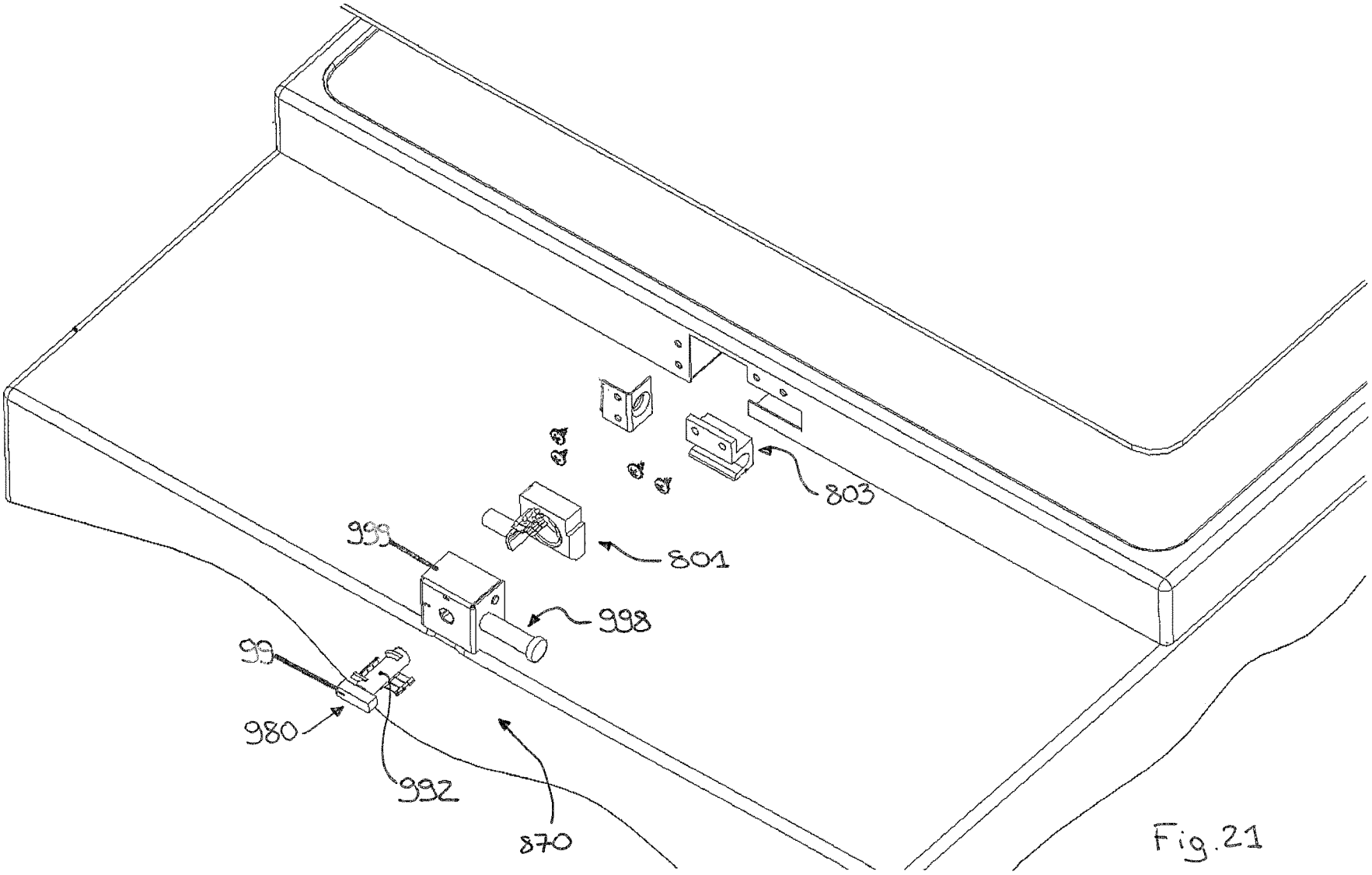
FIG. 21 shows a larger-scale view of the cooker according to the present invention.
Figure 24:
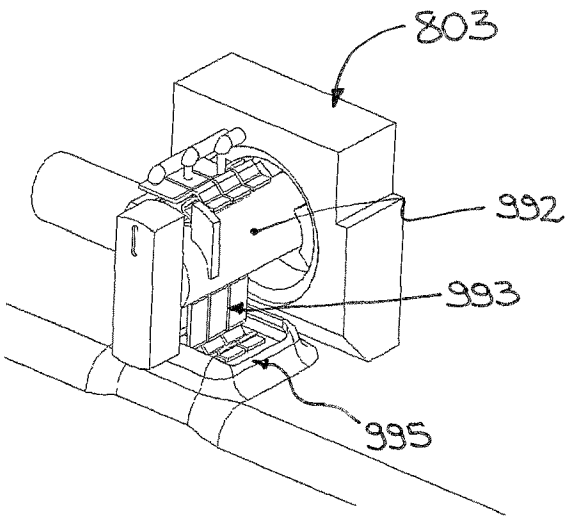
FIGS. 23 and 24 show a component of FIG. 21 in two different positions, said figures being shown considering an opposite viewpoint with respect to the one of FIG. 22.
Figure 23:
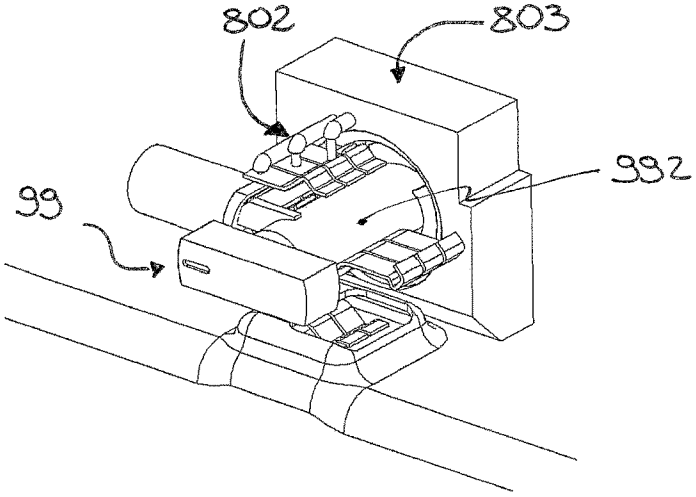
Figure 22:
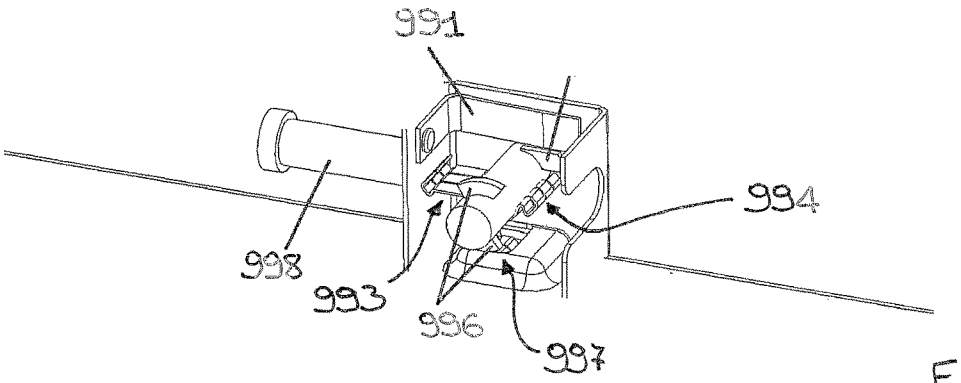
FIG. 22 shows a detail of FIG. 21.
Figure 25:
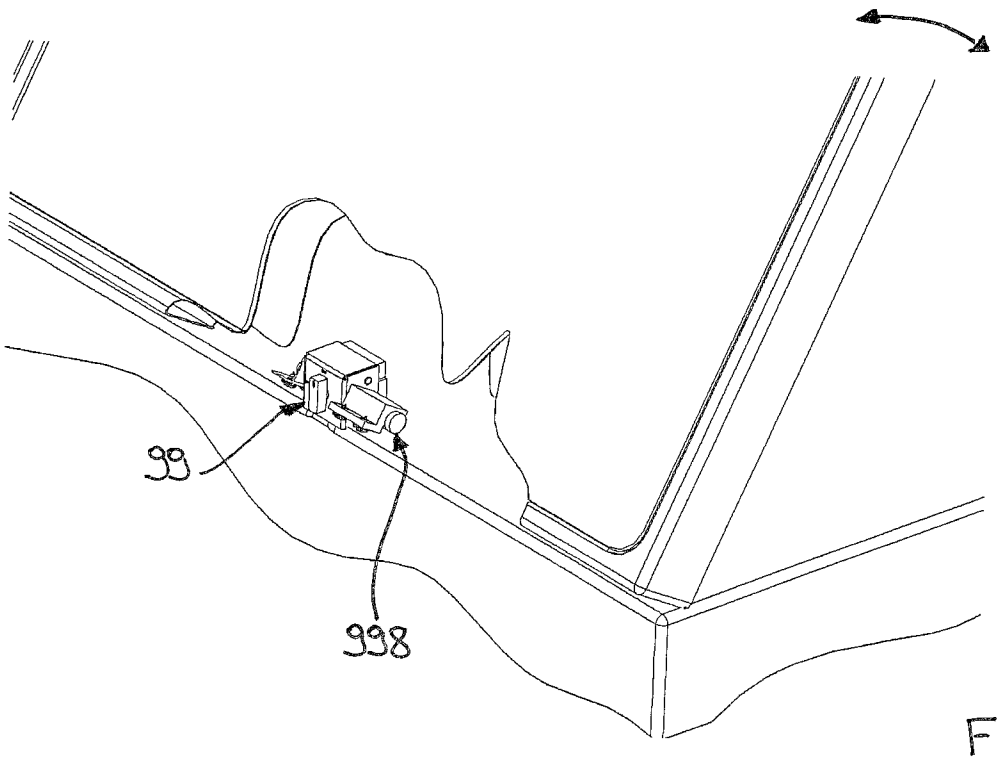
FIG. 25 shows a detail of FIG. 21 in an assembled configuration.

The freely installable cooker 1 could also comprise both the first cooking module 5 and a functional additional module 51 positioned beneath the resting surface 3. The functional additional module 51 is removable, interchangeable and housed in the support structure 2 (see FIG. 20). Said functional additional module 51 could be an oven or another household electrical appliance (for example, a dishwasher or a device for refrigerating food products). Opportunely, beneath the resting surface 3 a plurality of functional additional modules 51 could be present. Preferably, the functional additional modules 51 are different household electrical appliances. They could be alongside each other horizontally or stacked. For each functional additional module 51, what is described here could be repeated with reference to the first module 5.

Reference is now made to a possible embodiment wherein the first cooking module 5 is:

positionable on the resting surface 3;

mobile between a first and a second position. In the first position (see FIG. 7), the first cooking module 5 is substantially horizontal. In the second position (see FIG. 8), the first cooking module 5 is tilted upwards with respect to the first position. Opportunely, said tilting is by means of a first hinge 40. This assists cleaning of the resting surface 3.

The freely installable cooker 1 comprises electrical supply means 4 of the first cooking module 5. In the construction embodiment shown in FIGS. 6-10, the electrical supply means 4 comprise a first connector 41 rotatably, solidly joined to said first hinge 40. Also in the embodiment of FIGS. 6-10, the electrical supply means 4 comprise a second connector 42 solidly joined to the first cooking module 5. The first and second connectors 41, 42 may remain connected both in the first and in the second position. Advantageously, the freely installable cooker 1 comprises a switch of the electrical supply means 4. Said switch acts to prevent functioning of said first cooking module 5 when it is in the second position. The switch may be mechanically activated, for example by a mechanical abutment with which the switch comes into contact during passage from the first to the second position. Alternatively, the switch could be controlled gyroscopically.

Opportunely, the support structure 2 comprises a first and a second wall 871, 872. The support structure 2 further comprises a bottom wall 870 interposed and connecting the first and the second wall 871, 872. The first and second wall 871, 872 are vertical. On the first and second wall 871, 872, there are respectively afforded at least a first and a second insertion and extraction guide 210, 220 of said first functional module 5. The first and second insertion and extraction guides 210, 220 allow removable connection of the first functional module 5 with respect to the support structure 2 (the first and the second insertion and extraction guides 210, 220 therefore form part of the guide and support means 91 of the first functional module 5). Opportunely, the first and second insertion and extraction guides 210, 220 extend horizontally.

The first insertion and extraction guide 210 comprises an inner channel 211 open at one end. The first functional module 5 comprises a protrusion 50 which, in a configuration of connection to the support structure 2, is inserted in said inner channel 211. Similar considerations may be repeated for the second insertion and extraction guide 220.

The object of the present invention is also a system comprising:

a freely installable cooker 1 having one or more of the characteristics described above;

a second cooking module, the first cooking module 5 being replaceable with the second module.

The first and second cooking modules could belong to a different type of cooking points (for example, one could be an induction cooker hob and the other a steam cooker hob).

Figure 3:
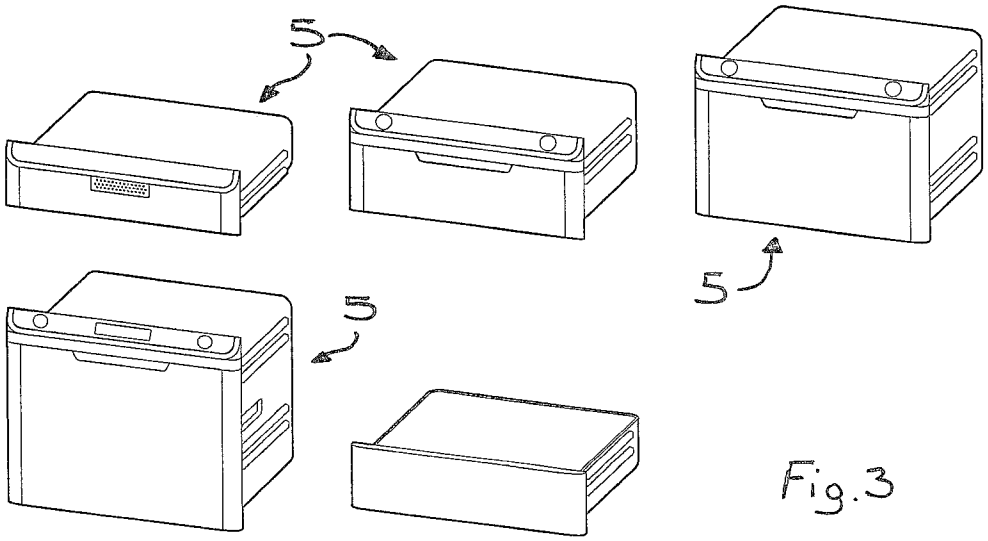
Figure 1:
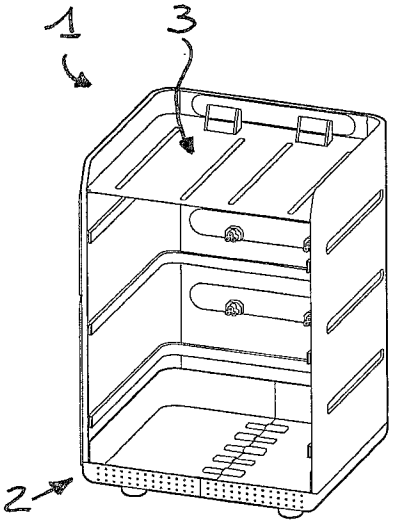
FIGS. 1 and 4 show a portion of the cooker according to the present invention.
Figure 5:
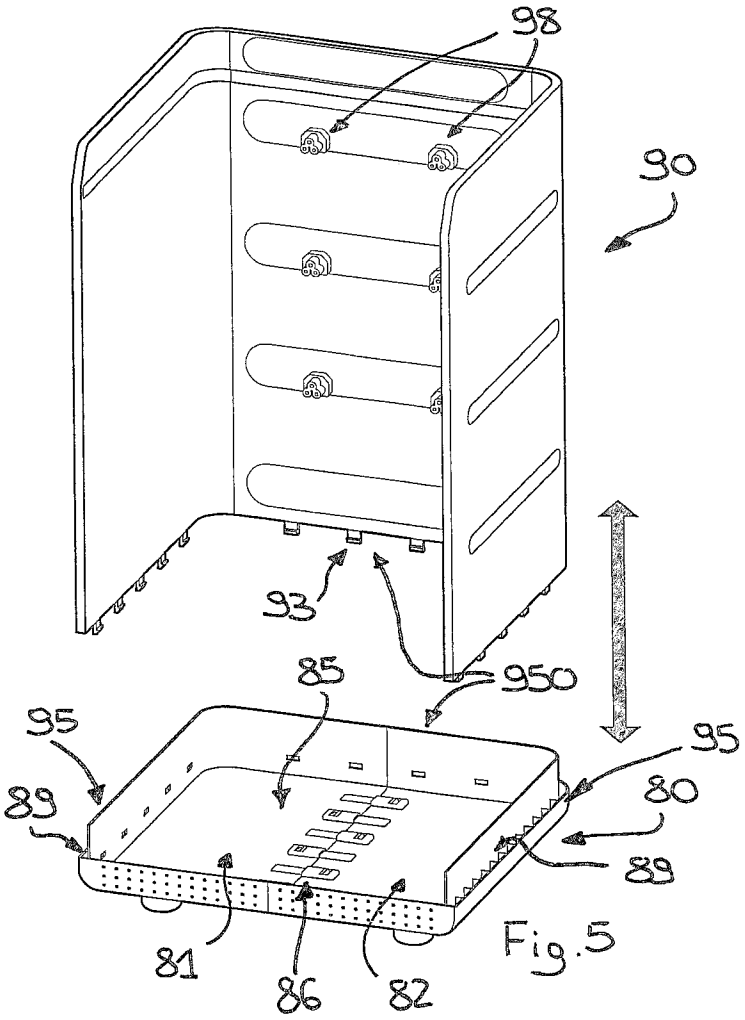
FIG. 5 is an exploded view of FIG. 4.
Figure 4:
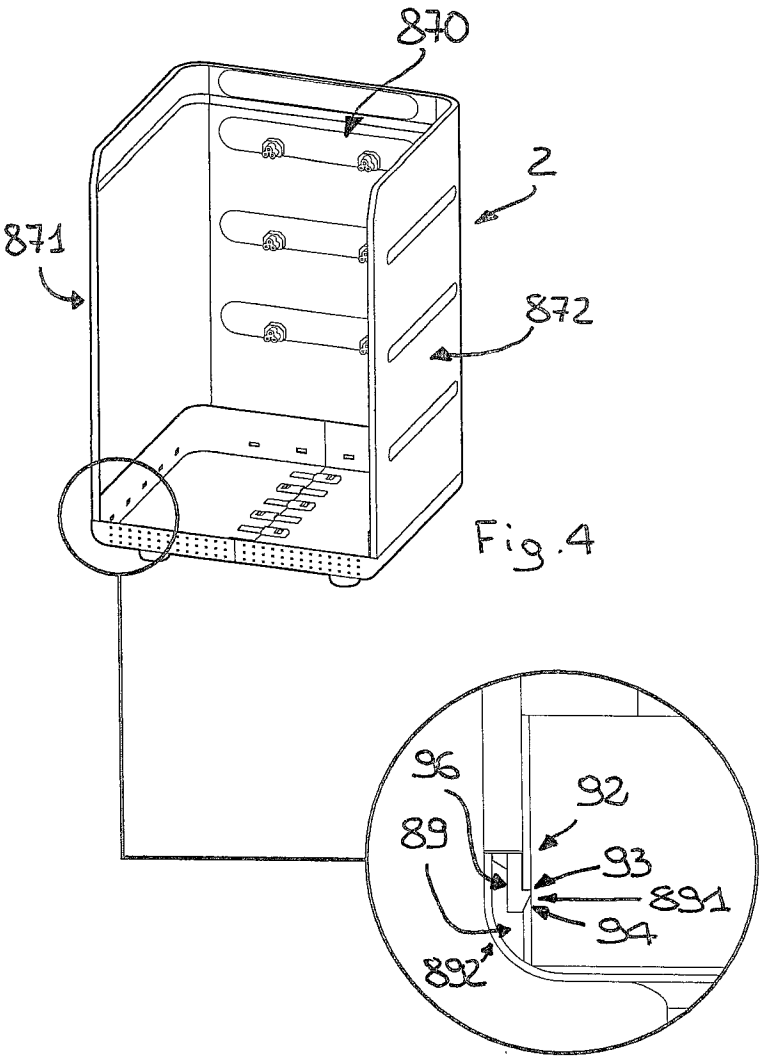

It could also be that the second model is an article washing module. In that case, the first functional module 5 (to be replaced) is opportunely, but not necessarily, an oven (and is positioned beneath the resting surface 3). An example of the cooking modules from which the first and second module could be chosen are shown in FIG. 2. Similar considerations may be repeated for the modules of FIG. 3.

An object of the present invention is also a method of realizing a freely installable cooker 1 comprising the steps of:

realizing a support structure 2 forming part of the freely installable cooker 1 and comprising the first housing 20;

choosing a predetermined first cooking module 5 from a group of separate, interchangeable cooking modules positionable in said first housing 20 and connectible to the support structure 2;

connecting said predetermined first cooking module 5 to said support structure 2.

Opportunely, the step of choosing the predetermined first cooking module 5 occurs typically during assembly. However, the method could provide, by the step of the final user, replacing said predetermined first cooking module 5 with another cooking module or more generally with another functional module.

As exemplified in the appended figures, the support structure 2 of the freely installable cooker 1 in turn comprises a base 80. The support structure 2 further comprises a containment structure 90 which extends between the top and the bottom, distancing itself from the base 80.

Figure 17:
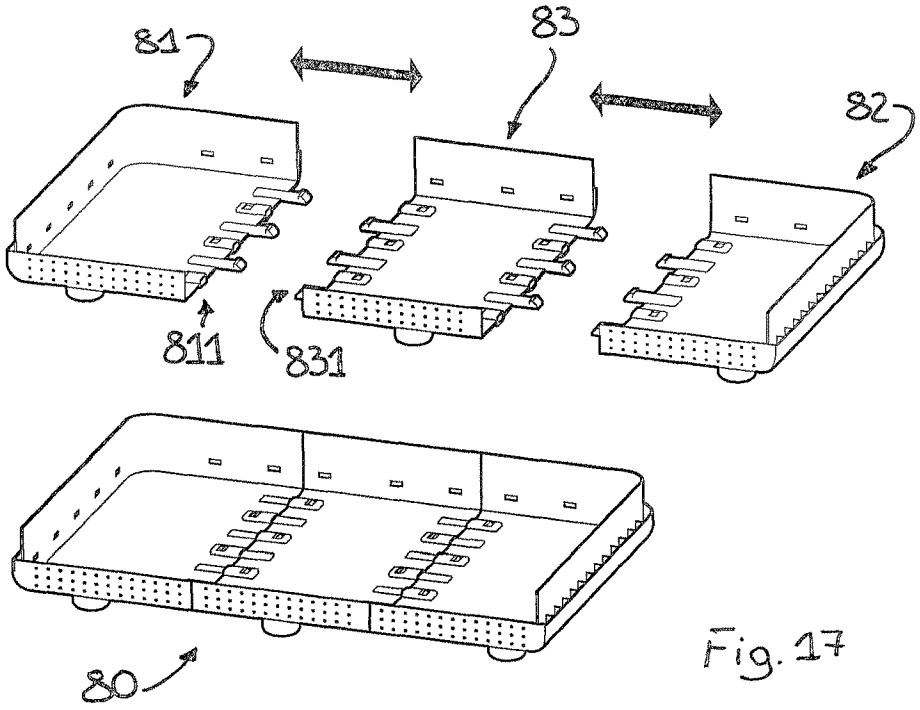
FIG. 17 shows a base (in an assembled configuration and in a partially larger-scale view) of the cooker according to the present invention.
Figure 16:
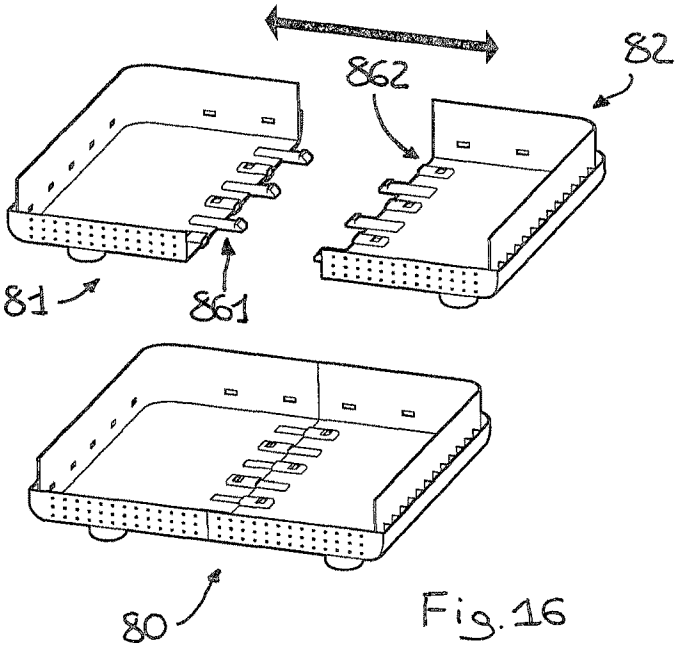
FIG. 16 shows a base (in an assembled configuration and in a partially larger-scale view) of the cooker according to the present invention.
Figure 19:
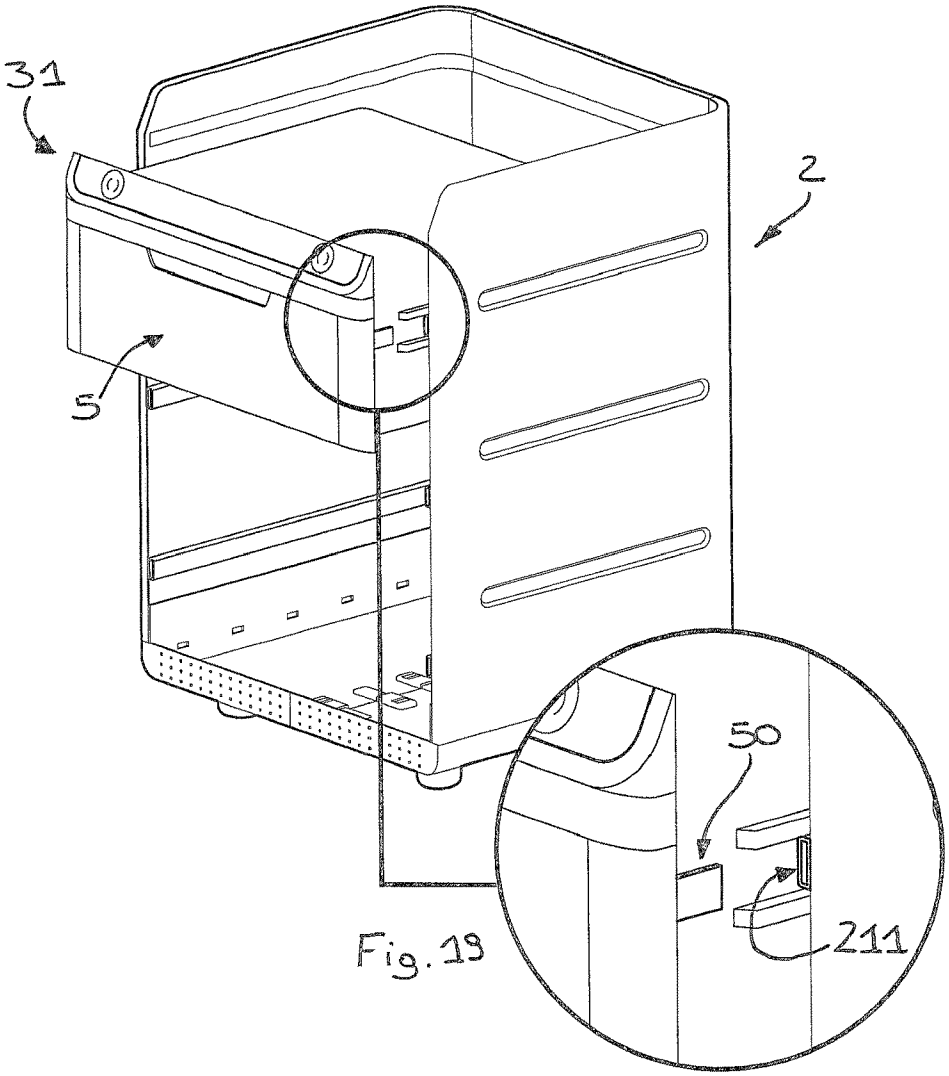
FIGS. 18 and 19 show a plan view and a perspective view of a cooker according to the present invention, partially assembled.
Figure 18:
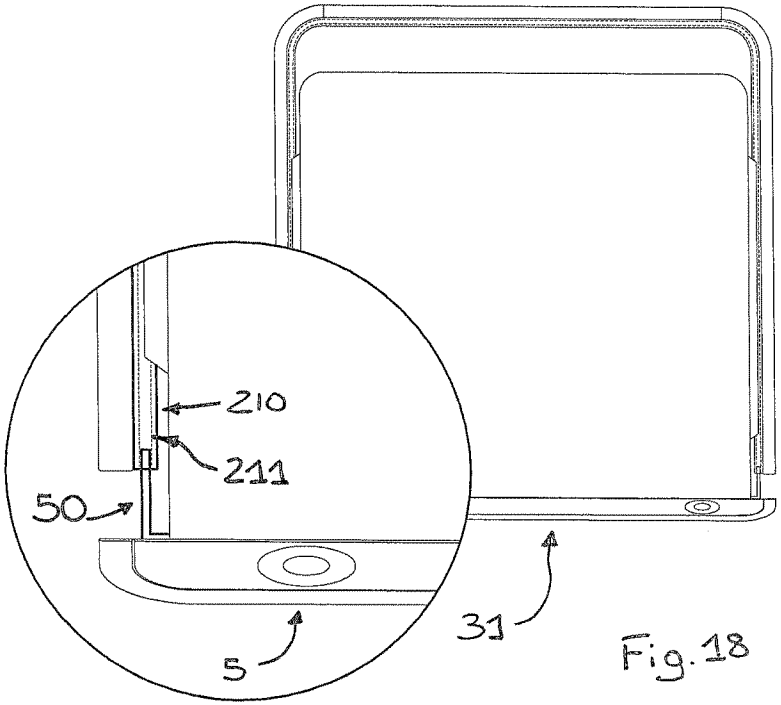

Preferably, the base 80 is an assembly of several panels. The panels are advantageously coplanar. The base 80 has a modular structure in order to reach the desired dimensions (see FIG. 16 or 17).

The modular structure of the base 80 comprises a plurality of panels in turn comprising:

a first panel 81;

a second panel 82.

The first and second panels 81, 82 contribute to defining a shared bottom surface 85.

Opportunely, said plurality of panels may comprise a third panel 83 interposed between the first and second panels 81, 82. The third panel 83 contributes to defining said shared bottom surface 85. In this way, the third panel 83 allows the base 80 to be elongated with respect to a situation in which only the first and the second panels 81, 82 are present.

For similar considerations, said plurality of panels may comprise a fourth panel adjacent to the third panel 83 and interposed between the first and the second panels 81, 82. The fourth panel contributes to defining the shared bottom surface 85.

The freely installable cooker 1 further comprises connection means 86 of two adjacent panels of the modular structure. The two adjacent panels may be chosen from said plurality of panels. The connection means 86 are afforded in a single piece with said two panels.

The connection means 86 of the two adjacent modules have a male-female type connection. Opportunely, the connection means 86 of the two adjacent modules comprise a plurality of inserts 861 which engage in corresponding housings 862. Opportunely, the inserts 861 engage in the housings 862 by means of elastic deformation. Advantageously, both adjacent modules alternate an insert and a housing forming part, respectively, of said plurality of inserts 861 and said plurality of housings 862.

The base 80 is quadrilateral. The third panel 83 of the support structure 2 comprises a first side 831 adjacent to a first edge 811 of the first panel; the connection means 86 are afforded at least along the first edge 811 and the first side 831.

In the preferred embodiment, the first panel 81 and/or the second panel 82 and/or the third panel 83 and/or the fourth panel are made of a plastic material. The freely installable cooker 1 could also comprise further panels. Preferably, all the panels of the base 80 extend in a row with one another along a straight line. Opportunely, the first panel 81 extends in a single piece. Opportunely, this could be repeated for the second panel 82 and/or the third panel 83 and/or the fourth panel.

Opportunely, the present invention further comprises a method of realization of a base 80 of a freely installable cooker 1. Opportunely, said freely installable cooker 1 has one or more of the characteristics described above. The method further comprises the step of connecting a plurality of modular elements of different shapes and dimensions in order to obtain a base 80 having pre-established dimensions.

With reference to the appended figures, the guide and support means 91 described above could be additional elements applied with attachment means to the remaining parts of the first and second walls 871, 872. In an alternative embodiment, the guide and support means 91 could be integrated into the first and into the second wall 871,872 (and in which case the guide and support means 91 would not be separable from the walls 871, 872). The first and the second wall 871, 872 could comprise a sandwich structure. In this case, the first and the second wall 871, 872 could comprise an outer covering 912, an inner covering 911 and interposed thermal isolation. In this case, the inner covering 911 defines the guide and support means 91. Typically, the inner and outer covering 911, 912 are made of a metal material.

Advantageously, the support structure 2 comprises connection means 92 of said base 80 and said containment structure 90. The connection means 92 comprise engagement means 93 and housing means 94 of said engagement means 93. The engagement means 93 and said housing means 94 are afforded where one is in said base 80 and the other is in said support structure 2. The connection between said engagement means 93 and said housing means 94 occurs at least at junction zones 95 of the first and the second walls 871, 872 with the base 80 and at a junction zone 950 of the bottom wall 870 and said base 80.

Advantageously, the connection means 92 comprise elastic deformation means 96 attachable in said housing means 94. Typically, said connection means 92 comprise deformable tabs.

The freely installable cooker 1 comprises activation means 98 of functioning of said first functional module 5. They are advantageously afforded at said bottom wall 870 (or in any case in a rear zone of the freely installable cooker 1). The activation means 98 may be activated manually in a first configuration, in which there is correct connection of said first functional module 5 and said containment structure 90 (or more generally of the support structure 2). In a particular embodiment, the activation means may comprise a selector 980. Said selector 980 only in said first configuration (i.e. when there is correct connection and positioning of the first functional module 5) allows the user to activate or not the functioning of the first functional module 5. Alternatively (non-preferred embodiment), said selector 980 could be activated directly by the correct connection of said first functional module 5 and said containment structure 90.

The activation means 98 assume a second configuration in which they prevent activation for functioning of the first functional module 5; opportunely, the passage from the second to the first configuration is determined by a mechanical thrusting action dictated by reaching of an end of stroke of the first functional module 5 (preferably along the guide and support means 91) and manual activation of said selector 980.

In said first configuration, the activation means 98 therefore come into contact with said first functional module 5. Opportunely, the first functional module 5 comprises an interface 801 destined to couple with said selector 980.

The activation means 98 therefore define a switch which, in the first configuration, is activated by the selector 980.

In the preferred embodiment shown in FIGS. 21-24, the activation means 98 (particularly the selector 980) comprise a knob 99. The selector 980 may assume a first position in which it prevents power supply of the first functional module 5. The selector 980 may assume a second position in which power supply of the first functional module 5 is permitted. The activation means 98 comprise a tab 991 which, in a blocking position, prevents rotation of the knob 99 from the first to the second position. The tab 991 may also assume an activation configuration in which it allows rotation of the selector 980 from the first to the second position. The second position of the selector 980 is assumed in said first configuration, i.e. when there is a correct connection and positioning of the first functional module 5. In fact, the first functional module 5 which has reached the end of stroke into said first configuration determines a movement of the tab 991 allowing rotation of the knob 99. The selector 980 comprises a stem 992 to which the knob 99 is solidly joined. The stem 992 in turn comprises at least a first and a second electrical contact 993, 994. Opportunely, the first and the second electrical contacts 993, 994 are elastic. In the second position of the selector 980, the first electrical contact 993 places in electrical communication said stem 992 and a power source 995 afforded on the support structure 2. In the second position of the selector 980 the second electrical contact 994 places in electrical communication said stem 992 and said first functional module 5.

Opportunely, the interface 801 of the first functional module 5 which interacts with the selector 980 comprises electrical wires 802 powered by said second electrical contact 994 and which allow power supply of the first functional module 5.

In this way, in the second position of the selector 980, electrical power supply of the first functional module 5 is permitted through the stem 992.

Advantageously, the stem 992 comprises an element (for example a fin 996) which, in the second position of the selector 980, interacts with a corresponding component 997 (which defines a housing 803) afforded in said first functional module 5 to prevent extraction of the first functional module 5. Opportunely, the freely installable cooker 1 comprises a pin 998 which engages in a counter-shaped housing 803 afforded on the first functional module 5. Opportunely, the pin 998 is solidly joined to a housing 999 of the selector 980. In said housing 999, said tab 991 is also advantageously housed. In this way, the first functional module 5 may rotate with respect to the support structure 2, which is solidly joined to the housing of the tab 991.

The bottom wall 870 comprises:

a frame 873 which delimits an opening;

infill material 874 which closes the opening, said activation means 98 being applied to said infill material 874.

The base 80 comprises a groove 89 which surrounds the base 80 on three sides and in which are engaged the first wall 871, the second wall 872 and the bottom wall 870.

The groove 89 extends at the junction zones 95 of the first and second walls 871, 872 with the base 80 and at the junction zone 950 of the bottom wall 870 and said base 80. The groove 89 is defined at least by:

a first side 891 in which said housing means 94 are advantageously afforded;

a second side 892, the engagement means 93 being insertable between the first and the second sides 891, 892 (and coming into contact with the first and the second wall 871, 872).

The present invention has numerous advantages. In particular, it allows the realization of a plurality of basic components (the support structure and the functional modules) which may then be assembled in various ways to allow the desired customization of the freely installable cooker 1. In this way, it is possible to choose the desired arrangement of the electrical household appliances in a support structure (as well as to choose which type of electrical household appliances to insert in the support structure). The invention as conceived is susceptible to numerous modifications and variants, all falling within the scope of the inventive concept characterized thereby. Furthermore, all the details can be replaced by other technically equivalent elements. In practice, all the materials used, as well as the dimensions, can be of any type according to requirements.

What is claimed is:

1. A freely installable cooker comprising:

a support structure received by a base and having side walls and a rear wall to define a housing;

a plurality of electrical connectors that are disposed within the rear wall, each electrical connector of the plurality of electrical connectors having first electrical connector that extends into the housing and a control knob positioned on a back surface of the rear wall; and a cooking module that is selectively disposed within the housing and includes at least one second electrical connector that selectively couples with the first electrical connector, wherein the cooking module includes an electrical appliance;

wherein the control knob is selectively operable when the second electrical connector is fully received within the first electrical connector to define an activation state, and wherein the control knob is in an inoperable state when the first electrical connector is distal from the activation state, wherein the activation state is characterized by selective activation of the electrical appliance, and wherein the inoperable state is characterized by the electrical appliance being coupled with the support structure and being inoperative.

2. The freely installable cooker of claim 1, wherein the first electrical connector includes opposing electrical contacts, wherein in the activation state, the opposing electrical contacts are selectively coupled with a first power contact of the support structure and a second power contact of the second electrical connector.

3. The freely installable cooker of claim 2, wherein the first power contact is in selective communication with an external power source.

4. The freely installable cooker of claim 3, wherein the second power contact is in selective communication with a control of the cooking module.

5. The freely installable cooker of claim 2, wherein the first electrical connector includes a locking tab that selectively maintains the control knob in the inoperable state, wherein when the second electrical connector is received by the first electrical connector to define the activation state, the locking tab is biased to a bypass position that is characterized by selective rotational operation of the control knob.

6. The freely installable cooker of claim 4, wherein rotation of the control knob in the activation state is defined by a contemporaneous engagement of the opposing electrical contacts and the first and second power contacts that defines a powered state of the cooking module.

7. The freely installable cooker of claim 5, wherein the control knob includes a stem that extends through the rear wall of the support structure to define the first electrical connector.

8. The freely installable cooker of claim 7, wherein the stem includes a blocking fin that selectively engages the locking tab to define the inoperable state.

9. The freely installable cooker of claim 7, wherein the opposing electrical contacts extend from the stem.

10. A freely installable cooker comprising:

a support structure received by a base and having side walls and a rear wall that define a housing, wherein the base and the support structure are selectively adjustable to define an adjustable volume of the housing;

a plurality of electrical connectors disposed within the rear wall, each electrical connector of the plurality of electrical connectors including a stem that extends from a control knob that is positioned on a back surface of the rear wall, through the rear wall and to a first electrical connector that extends into the housing; and a cooking module having an electrical appliance, wherein the cooking module is selectively disposed within the housing and includes a second electrical connector that selectively couples with the first electrical connector to define an activation state, wherein the control knob, the stem and the first electrical connector are rotationally operable in the activation state and rotationally fixed in an inoperable state when the cooking module is distal from the activation state, wherein the activation state is characterized by selective activation of the electrical appliance, and wherein the inoperable state is characterized by the electrical appliance being coupled with the support structure and being inoperative.

11. The freely installable cooker of claim 10, wherein the first electrical connector includes a pin that extends substantially perpendicular to the stem, and wherein the second electrical connector of the cooking module includes a rotational member that couples with the pin and is rotationally operable about a rotational axis of the pin between a horizontal position and a tilted position.

12. The freely installable cooker of claim 10, wherein the stem includes at least one flange that couples with a portion of the cooking module in the activation state, wherein engagement of the at least one flange with the portion of the cooking module defines a secured state of the cooking module that substantially prevents extraction of the cooking module from the housing.

13. The freely installable cooker of claim 10, wherein the stem includes a locking tab that selectively maintains the stem, the control knob and the first electrical connector in the inoperable state, wherein when the second electrical connector is received by the first electrical connector, the locking tab is biased to the activation state that is characterized by selective rotational operation of the control knob, the stem and the first electrical connector.

14. The freely installable cooker of claim 10, wherein rotation of the control knob in the activation state is defined by a contemporaneous engagement of opposing electrical contacts of the stem with a first power contact of the support structure and a second power contact of the cooking module, respectively, that defines a powered state of the cooking module.

15. The freely installable cooker of claim 13, wherein the stem includes a blocking fin that selectively engages the locking tab to define the inoperable state.

16. The freely installable cooker of claim 14, wherein the first power contact is in selective communication with an external power source.

17. The freely installable cooker of claim 16, wherein the second power contact is in selective communication with a control of the cooking module.

18. A freely installable cooker comprising:

a support structure received by a base having an adjustable width and having side walls and a rear wall that define a housing having a selectively adjustable volume;

a plurality of electrical connectors disposed within the rear wall, each electrical connector of the plurality of electrical connectors including a stem that extends from a control knob that is positioned on a back surface of the rear wall, through the rear wall and to opposing electrical contacts that extends radially from the stem, wherein the opposing electrical contacts extend into the housing;

a power-delivery contact positioned proximate the stem and laterally aligned with the opposing electrical contacts; and a cooking module that is selectively disposed within the housing to define an activation state, the cooking module including a module electrical connector that selectively couples with the electrical connector proximate the stem, wherein the opposing electrical contacts are selectively operable in the activation state to contemporaneously engage the power-delivery contact and the module electrical connector, and wherein the stem is selectively fixed in an inoperable state when the cooking module is disengaged from the electrical connector, wherein the activation state is characterized by selective activation of an electrical appliance of the cooking module, and wherein the inoperable state is characterized by the electrical appliance being coupled with the support structure and being inoperative.

19. The freely installable cooker of claim 18, wherein the electrical connector includes a locking tab that selectively maintains the control knob in the inoperable state, wherein when the module electrical connector is received by the electrical connector, the locking tab is biased to the activation state that is characterized by selective rotational operation of the control knob.

20. The freely installable cooker of claim 19, wherein the stem includes a blocking fin that selectively engages the locking tab to define the inoperable state.

* * * * *